US005197728A

United States Patent [19]

Radtke

[11] Patent Number: 5,197,728

[45] Date of Patent: Mar. 30, 1993

[54] GUIDING DEVICE FOR SHEETS SUPPLIED TO A STACKING SITE

[75] Inventor: Manfred Radtke, Korb, Fed. Rep. of Germany

[73] Assignee: Eastman Kodak Company, Rochester, N.Y.

[21] Appl. No.: 799,213

[22] Filed: Nov. 27, 1991

[30] Foreign Application Priority Data

Jan. 21, 1991 [DE] Fed. Rep. of Germany ..... 4101612

[51] Int. Cl.[5] ..... B65H 31/26

[52] U.S. Cl. ..... 271/220; 271/177

[58] Field of Search ..... 271/220, 245, 227, 177

[56] References Cited

U.S. PATENT DOCUMENTS 4,474,366 10/1984 Reider ..... 271/220 X 5,033,731 7/1991 Looney ..... 271/220 X 5,040,784 8/1991 Akashi ..... 271/220 X

FOREIGN PATENT DOCUMENTS 2631115 10/1976 Fed. Rep. of Germany .

*Primary Examiner*—Richard A. Schacher

*Attorney, Agent, or Firm*—Lawrence P. Kessler

[57] ABSTRACT

A guiding device for sheets (3) supplied to a stacking site (1), the sheet-guiding device includes at least one freely movable and pivotally suspended guide element (21), such guide element having an abutment surface (35) for the incoming sheets (3). Guide element (21) is shaped such that its abutment surface (35) encloses a predetermined acute angle with the vertical plane which is defined by the axis of rotation of guide element (21) and its center of gravity.

3 Claims, 1 Drawing Sheet

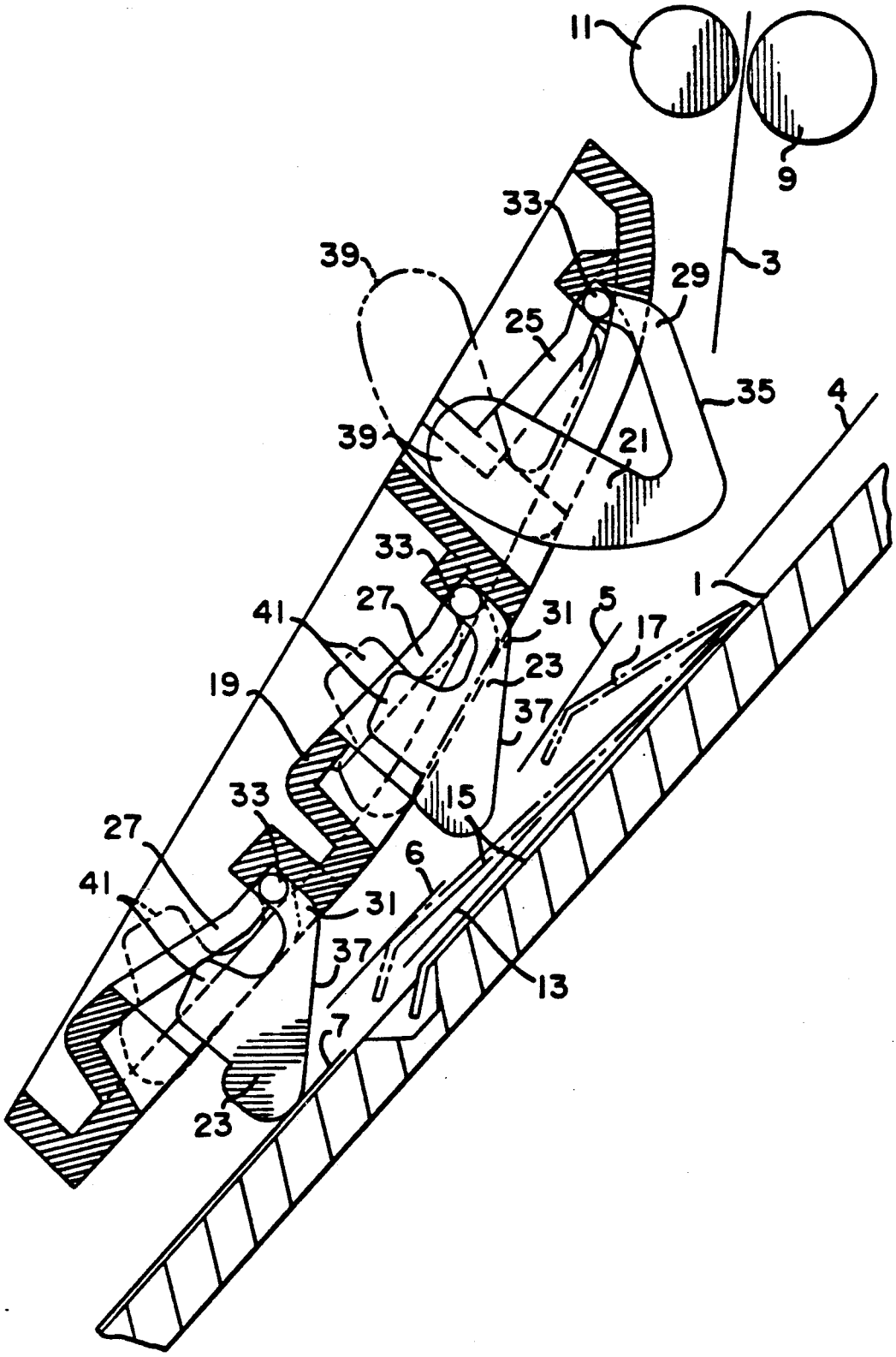
11
9
33
3
39
29
25
35
4
39
21
33
1
27
31
5
41
17
23
19
37
33
15
27
6
41
31
37
13
7
23

GUIDING DEVICE FOR SHEETS SUPPLIED TO A STACKING SITE

BACKGROUND OF THE INVENTION

The invention relates, in general, to a guiding device for sheets supplied to a stacking site and, more particularly, to a sheet-guiding device having at least one guide element which can be pivoted about an upper journal and an abutment surface for the front edges of the sheets arriving in an entrance direction, such surface being downwardly inclined with respect to the entrance direction.

Devices for guiding sheets to a stacking site (collecting tray) are generally known. In such known devices, the guide elements are designed as wire straps whose free lower ends, which are remote from their journal, rest on the bottom of a sheet-collecting tray or on the sheet deposited in such a collecting tray. Owing to their weight, the wire straps function as hold-down elements. The length of the straps is chosen such that the support of their free lower ends causes them to assume an inclined position in which they form an inclined, downwardly directed abutment surface for the incoming sheets. However, the inclination of the abutment surface changes during operation when the stack sheets supplied to the stacking site becomes higher because the support plane of the free end of the known guide element on the stack is moving away from the bottom of the collecting tray by a distance corresponding to the stack height. During operation, this results in a non-uniform guiding action of the guide element.

SUMMARY OF THE INVENTION

This invention is directed to a guiding device which provide a particularly efficient guiding action on the incoming sheets. The guiding device, according to this invention includes a guide element shaped such that its abutment surface encloses a predetermined acute angle with the plane that is defined by the axis of rotation of the guide element and the center of gravity thereof.

In this manner, the abutment surface of the guide element can also be downwardly inclined with respect to the direction of entrance, if the guide element is freely suspended, i.e., not supported at its free lower end. If the guide element is freely suspended and thus not resting with its free end on the bottom of the collecting tray or on sheets already deposited, the plane defined by the axis of rotation and the center of gravity of the guide element is the vertical plane. Since the guide element is shaped such that its abutment surface is inclined at an angle to this plane, the abutment surface assumes the desired inclined position relative to the direction of entrance of the sheets without the free lower end of the guide element having to be supported and irrespective of the direction of entrance of the sheets. Even if the direction of entrance of the sheets is almost vertical,, which may happen, for example, if the sheet-stacking site or collecting tray has a bottom which is relatively steeply inclined to the horizontal, the shape of the guide element, according to the invention, results in the desired inclination of the abutment surface to the direction of entrance without the guide element being supported at it lower end. If the guide elements are arranged one behind the other in the entrance direction, at least the first guide element can be positioned with respect to the stacking site such that it does not rest on the sheets when the sheet stack reaches its maximum height and that the inclination of the abutment surface always remains constant when contacted by the front edges of the incoming sheets. According to preferred embodiments of this invention, the guide element may be C-shaped or U-shaped with one leg forming the abutment surface and the other serving as a counterweight or adjustment weight which, by its mass and shape, determines the inclination of the abutment surface relative to the vertical plane.

The invention, and its objects and advantages, will becomes more apparent in the detailed description of the preferred embodiment presented below.

BRIEF DESCRIPTION OF THE DRAWING

The invention will not be explained in further detail with reference to the drawing, in which:

The single figures schematically shows a side elevational view, in cross-section with parts broken away, of the sheet-guiding device according to this invention, in connection with a sheet-stacking site having a bottom surface or sheet-supporting surface inclined to the horizontal.

DESCRIPTION OF THE PREFERRED EMBODIMENT

Referring to the accompanying drawing, the sheet-stacking site illustrated comprises a bottom surface or sheet-supporting surface 1 which is inclined by an angle of slightly more than 45° to the horizontal. Paper sheets 3 are supplied to the site by driven transport rollers 9, and cooperating pressure rollers 11, which are arranged above the sheet-supporting surface 1. When leaving the rollers, 9, 11, the sheets move in a downwardly inclined direction. The sheet-supporting surface 1 is adapted to support sheets of different format whose leading edges, seen in the direction of entrance, abut a lower sheet abutment (not illustrated) when reaching their final position. Sheet 7, shown in the drawing in its final position, is a sheet of the A4 format or the US format of $8\frac{1}{2}\times 11''$. The path of an incoming sheet of this format, which has not yet reached its final position, is denoted 6 while reference numeral 5 denotes the path of an incoming sheet of the US format of $8\frac{1}{2}\times 14''$, which has not yet reached its final position, and reference numeral 13 a sheet of that format in its final position. Reference numeral 4 indicates the final position of a sheet of a larger format of, say, DIN A3 or the US format $11\times 17''$.

On the sheet-supporting surface 1, movable sheet-metal fenders 15 and 17 are arranged in a known manner. Feather 15, adapted for small format, is shown in both of its possible adjustment positions. When a sheet arrives which is to be deposited on top of a sheet stack located downstream of the fender 15 or 17, the fenders are lifted off the sheet-supporting surface 1 into the adjustment positions shown in dash-dotted lines. When a large-format sheet, as illustrated at 4, is to be deposited, however, which extends beyond such fenders they remain in the adjustment positions in which they are not lifted off such surface.

Above the sheet-supporting surface 1 and spaced therefrom, a mounting member 19 is provided for a plurality of guide elements 21 and 23. Three guide elements are shown in the drawing arranged one behind the other in the direction of entrance. The mounting member 19 is molded from a plastic material and shaped such that its downstream portion, seen in the direction of entrance of the sheets, extends at a distance from and substantially in parallel with the sheet-supporting surface 1. In its area located further upstream, i.e., adjacent to the rollers 9, 11, the mounting member has an arcuate curvature so that its distance from the sheet-supporting surface 1 is greatest at the upper end where the sheet arrive.

Mounting member 19 has cutouts 25 and 27. The guide elements 21 and 23, respectively, are suspended from upstream opening edges of the cutouts 25 and 27, seen in the direction of the entrance. The size of the cutouts 25 and 27 is chosen such that the guide elements 21 and 23, respectively, can at least partially pass through them. In the embodiment illustrated, the guide elements 23, 23 are approximately U-shaped die-cast metal parts consisting of a zinc alloy and comprising at the free end of one of their legs 29 and 32, respectively, journals 33 integral with either of their sides. The journals 33 are seated in corresponding bearings of the mounting member 19 and are locked by snapping in a manner usual with plastic components. The axis of rotation of the journals 33 extends parallely with the plane of the sheet-supporting surface 1 and vertically to the direction of entrance of the sheets 3. Accordingly, the guide elements 21 and 23 are pivotable in a plane which extends in the direction of entrance and vertically to the sheet-supporting surface 1.

Each of the guide elements 21 and 23 forms an abutment surface 35 and 37, respectively, for incoming sheets 3 at the upstream front side of one of its legs 29 and 31, respectively. The other leg 39 and 41, each of the guide elements 21 and 33, respectively, serves as a counterweight or adjustment weight. Thus, the center of gravity of the guide element 21 23, respectively as a whole, is positioned such that, combined with the free and unsupported suspension of the guide elements 21, 23, the abutment surface 35 and 37, respectively, is inclined in the desired manner relative to the vertical plane, i.e., the plane defined by the axis of rotation of the journals 33 and the center of gravity. In the case of guide element 21, the mass of the counterweight provided by leg 39 is relatively great, and the distance from the other leg 29 is relatively great as well, which results in a relatively steep inclination of leg 29 and its abutment surface 35, relative to the vertical. The arrangement, relative to the sheets, which are supplied by the rollers 9, 11 in an almost vertical direction, thus leads to a desired acute angle being defined between sheet 3 and abutment surface 35 (see the figure). Moreover, this guide element is suspended such that it does not rest on the sheets even when the stack reaches its maximum height.

In the case of the guide elements 23, which are further downstream, the mass of the counterweight formed by leg 41 is smaller. Its distance from leg 31, forming the abutment surface 37, is smaller as well. Combined with the free suspension of guide element 23, this results in a relatively slight inclination of abutment surface 37 to the vertical. Considering the direction of entrance of the sheets in the range of guide element 23, indicated at 5 in the drawing, the desired acute angle between the direction of entrance and the abutment surface 37 is again obtained.

The guide elements 23 and 23, which in the case of the embodiment, have a thickness of about 3 mm, are arranged one behind the other in the direction of entrance, as shown in the figure. Additionally, the guide elements are also arranged side-by-side in a direction running vertically with respect to the plane of the drawing and distributed across the width of the sheet, their positions being adapted to the sheet formats to be handled.

The above description and the drawing are confined to feature which are essential to the disclosure of an example of the invention. Features which, although disclosed in the description and in the drawing, are not mentioned in the claims also serve, if necessary, to define the subject matter of the invention.

I claim:

1. Guiding device for sheets (3) supplied to a stacking site (1), said sheet-guiding device comprising:

at least two guide elements (21, 23), arranged one behind the other in the entrance direction, pivoted about an upper journal (33), said guide elements having a respective abutment surface (35, 37) for the front edges of the sheets (3) arriving in an entrance direction, said abutment surface being downwardly inclined with respect to said entrance direction, each of said guide elements (21, 23) shaped such that its abutment surface (35, 37) encloses a predetermined acute angle with the plane defined by said journal (33) for said guide element (21, 23) and its center of gravity, at least the first guide element (21) being suspended relative to the stacking site (1) such that it is spaced from such stacking site.

2. Guiding device according to claim 1 wherein said guide element (21, 23) extends on their side of the plane defined by said journal (33) and said center of gravity and at one side forms said abutment surface (35, 37) and at the other a counterweight (39, 41) which determines the position of said abutment surface.

3. Guiding device according to claim 2 wherein said at least one guide element (21) is substantially U-shaped and that one leg (29) forms said abutment surface (35) and the other leg serves as said counterweight (39).

* * * * *

UNITED STATES PATENT AND TRADEMARK OFFICE

CERTIFICATE OF CORRECTION

PATENT NO. : 5,197,728

DATED : March 30, 1993

INVENTOR(S) : Manfred Radtke

It is certified that error appears in the above-indentified patent and that said Letters Patent is hereby corrected as shown below:

Column 4, line 45, claim 2, change "their" to --either--.

Signed and Sealed this

Fourth Day of January, 1994

*Attest:*

*Attesting Officer*

BRUCE LEHMAN

*Commissioner of Patents and Trademarks*